United States Patent [19]

Parks et al.

[11] Patent Number: 4,534,281

[45] Date of Patent: Aug. 13, 1985

[54] LABORATORY FUME HOOD

[75] Inventors: James D. Parks, Johnson County, Kans.; Charles A. Moss, Jackson County, Mo.; Kermit W. Dyer, Johnson County, Kans.

[73] Assignee: Labconco Corporation, Kansas City, Mo.

[21] Appl. No.: 535,639

[22] Filed: Sep. 26, 1983

[51] Int. Cl.[3] ..... F23J 11/00

[52] U.S. Cl. ..... 98/115.3

[58] Field of Search ..... 55/DIG. 18; 98/115 R, 98/115 LH; 126/299 R, 299 D, 299 E

[56] References Cited

U.S. PATENT DOCUMENTS

| | | | |
|---|---|---|---|
| 3,111,077 | 11/1963 | Cortright | 98/115 LH |
| 3,237,548 | 3/1966 | Bayern | 98/115 LH |
| 3,408,914 | 11/1968 | Bayern | 98/115 LH |
| 3,410,195 | 11/1968 | King | 126/299 E |
| 3,745,908 | 7/1973 | Mayberry | 98/115 LH |
| 3,956,977 | 5/1976 | Turko et al. | 98/115 LH |
| 4,100,847 | 7/1978 | Norton | 98/115 LH |

OTHER PUBLICATIONS

"Kewaunee Laboratory Fume Hoods", Kewaunee Manufacturing Company, Adrian, Michigan, Section 2, 1965, pp. 61, 62 and 70.

"LABCONCO Laboratory Equipment and Apparatus", Labconco Corporation, Kansas City, Missouri, 1966, pp. 11, 17, 19 and 23.

*Primary Examiner*—Harold Joyce

*Attorney, Agent, or Firm*—Kokjer, Kircher, Bradley, Wharton, Bowman & Johnson

[57] ABSTRACT

An improved laboratory fume hood is the subject of the present invention. A cabinet structure presents an enclosed work area defined by sidewalls, a back wall, and an access opening. Each of the sidewalls presents first and second planar surfaces disposed in spaced parallel planes and interconnected by a third surface disposed at an acute angle relative to the plane of one of the first two surfaces. This third surface provides a mounting area for hose connectors which increases the effective work area and reduces the danger of clothing catching on the hose connectors. A vertically mounted sash covers the access opening and is movable between a lowered closed position and a raised open position. A fixture mounted in front of the sash provides means for mounting a light source. A removable cover on the side of the sash opposite the work area cooperates with the sash to define an air duct for directing add air into the access opening. In this regard, air foils are presented for directing the air into the opening at an angle of approximately 90° relative to the plane of the opening. These same openings are utilized to draw in outside air which passes over the top of the sash when the latter is partially closed.

16 Claims, 9 Drawing Figures

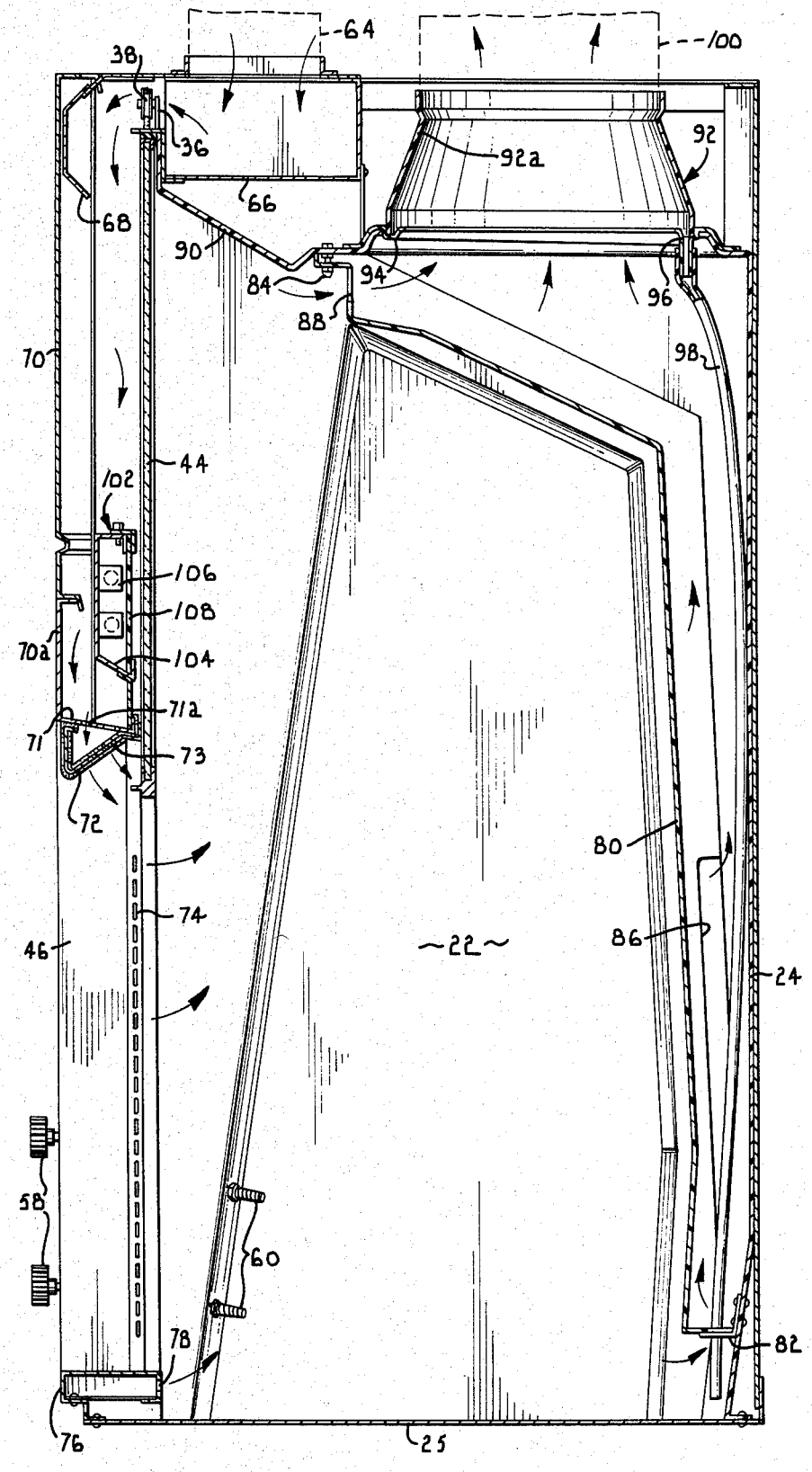
Fig. 5.
Fig. 6.
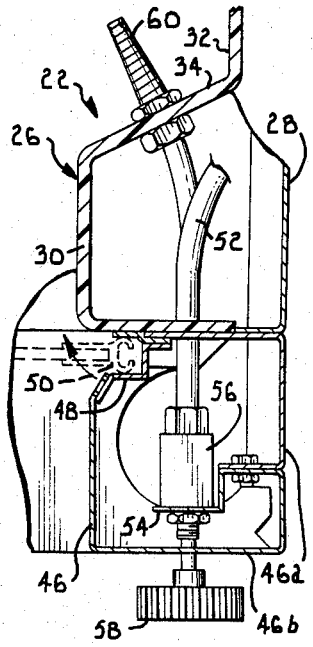
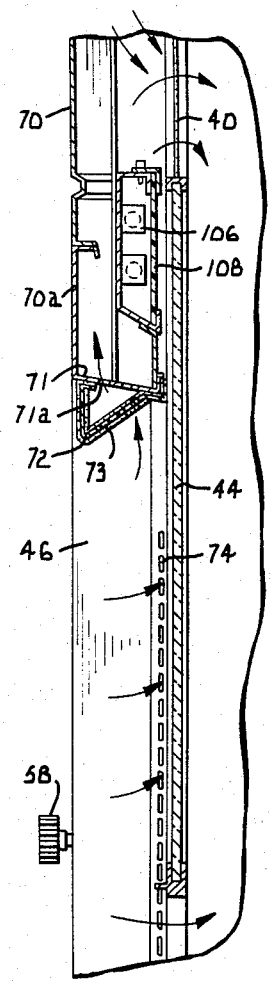
Fig. 7.

LABORATORY FUME HOOD

This invention relates generally to laboratory work cabinets and, more particularly, to an improved fume hood which may include provision for auxiliary air to be supplied to the work area.

Enclosed work cabinets for laboratories employing exhaust fans for removing undesirable and dangerous fumes are well known in the laboratory construction industry. Numerous examples of fume hood constructions are shown in the prior art.

The prior art patent to Landingham et al. U.S. Pat. No. 3,340,788 discloses a fume hood which provides for both auxiliary air and exhaust features. The auxiliary air is added to the inside of the work area, which is known to limit the quantity of auxiliary air to about 50% of the exhaust capabilities and is also known to contribute to an unbalanced face profile of the air within the hood. This unbalanced profile is potentially disruptive of the work being carried out within the hood.

The prior art patents to Chamberlin et al. U.S. Pat. Nos. 3,752,056 and 3,318,227 both disclose fume hoods where auxiliary air is added in front of the vertical sash that is used to close the access opening. While such a construction offers some advantages it also results in a noticeable draft on a worker positioned in front of the sash. Furthermore, with a worker positioned in front of the sash, there is some disruption of the air flow which will cause some loss of auxiliary air.

It has also been a characteristic of many of the prior art constructions for fume hoods that the auxiliary air (sometimes referred to as "add air") duct intersects the exhaust duct. This results in the need to provide an air tight seal between the two to combat the possibility of contamination of the add air which can occur under certain circumstances.

Another problem that is encountered with laboratory fume hoods is condensation of vapor in the exhaust system. This can result in annoying drips from the exhaust opening and more serious contamination problems within the work area. With fume hoods of the prior art where provision has been made for supplying gases and liquids to the work area, valves are provided for controlling the flow of these supplies. It has been the practice to locate such supply valves in the sidewalls of the hood where they are largely inaccessible without a major disassembly and same can be exceedingly difficult if a number of hoods are placed in side by side relationship. It is also the practice to provide hose connectors from the supply lines which project into the work area from one of the sidewalls. These connectors are typically unshielded and provide an obstacle on which clothing may catch. They also reduce the effective working area. Obtaining access to fume hood lighting fixtures is often difficult with prior art constructions.

With the foregoing in mind, it is a primary object of the present invention to provide a laboratory fume hood having provision for add air wherein the add air duct does not intersect the exhaust duct thus eliminating the need for a seal between the two and substantially eliminating the risk of contamination of the add air by the exhaust system.

Another important object of the invention is to provide a laboratory fume hood with add air which does not blow air on a technician standing in front of the work area and yet introduces the air at the front of the access opening.

As a corollary to the preceding object, an important aim of the invention is to provide add air to the work area of a fume hood around the entire periphery of the access opening.

Another corollary to the previously stated object is to provide a more uniform face velocity than has been possible with prior art constructions.

An important aim of the invention is also to provide a laboratory fume hood with add air wherein the same openings that direct add air to the work area may be utilized to draw outside air into the area when the sash which closes the access opening is partially or completely closed.

It is also one of the aims of our invention to provide a laboratory fume hood having add air wherein the air is introduced into the work area at a more effective angle than with prior art add air hoods.

Still another objective is to provide a laboratory fume hood with add air haing reduced loss of the auxiliary air when a worker is positioned in front of the hood than with prior art constructions.

An important object of the invention is to provide a laboratory fume hood exhaust system having condensation control which substantially eliminates condensed vapors from dripping back into the work area.

As a corollary to the foregoing object, one of the aims of the invention is to provide condensation control for a laboratory fume hood so as to remove corrosive liquids to the extent possible from the exhaust system thereby prolonging the life of the system.

It is also an object of this invention to provide a laboratory fume hood having control valves for liquids and gases supplied to the work area which control valves are accessible by removing a front cover plate from the cabinet.

Another important objective of the invention is to provide a laboratory fume hood of the type described wherein the hose connectors for liquids and gases supplied to the work area extend at an angle relative to the sidewalls of the work area, as well as being angled toward the work surface, and are behind the plane of a portion of the sidewalls.

An important aim of this invention is to provide a laboratory fume hood having a light fixture disposed forwardly of the hood sash and readily accessible from the front of the hood for servicing.

An objective of the invention is to provide an exhaust fan for a laboratory fume hood which simplifies the hood construction and increases the interior area of the hood by eliminating the presence of elbows within the hood itself.

Still another one of the objectives of the invention is to provide an improved exhaust fan for laboratory fume hoods which is belt driven and which is provided with a variable speed sheave so as to accommodate differing exhaust system requirements.

Other objects of the inventions will be made clear or become apparent from the following description and claims when read in light of the accompanying drawings wherein:

FIG. 5 is an enlarged vertical cross-sectional view taken along line 5—5 of FIG. 2;

FIG. 6 is an enlarged horizontal cross-sectional view taken along line 6—6 of FIG. 3;

FIG. 7 is a fragmentary vertical cross-sectional view of a portion of the fume hood shown in FIG. 5;

Figure 1:
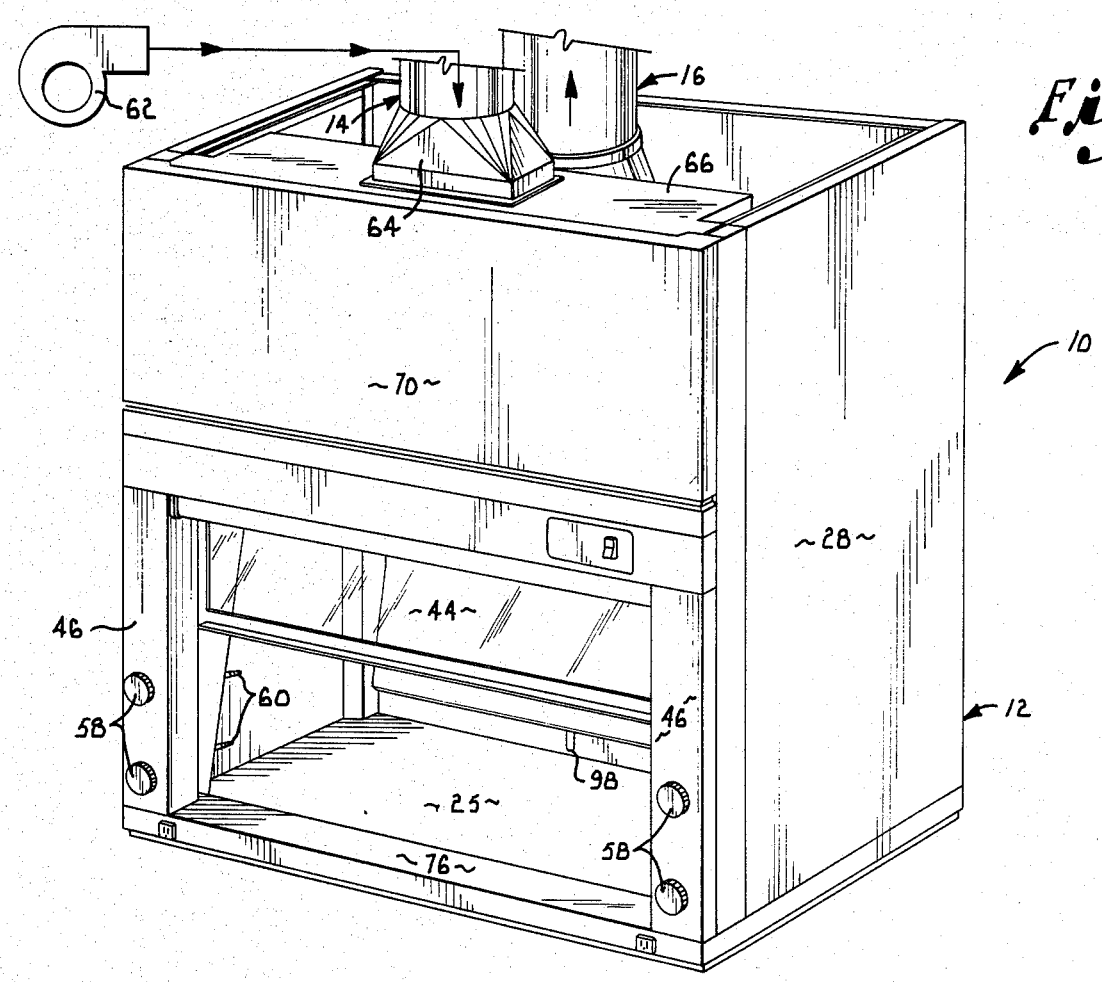
FIG. 1 is a perspective view of a laboratory fume hood according to the present invention.
Figure 2:
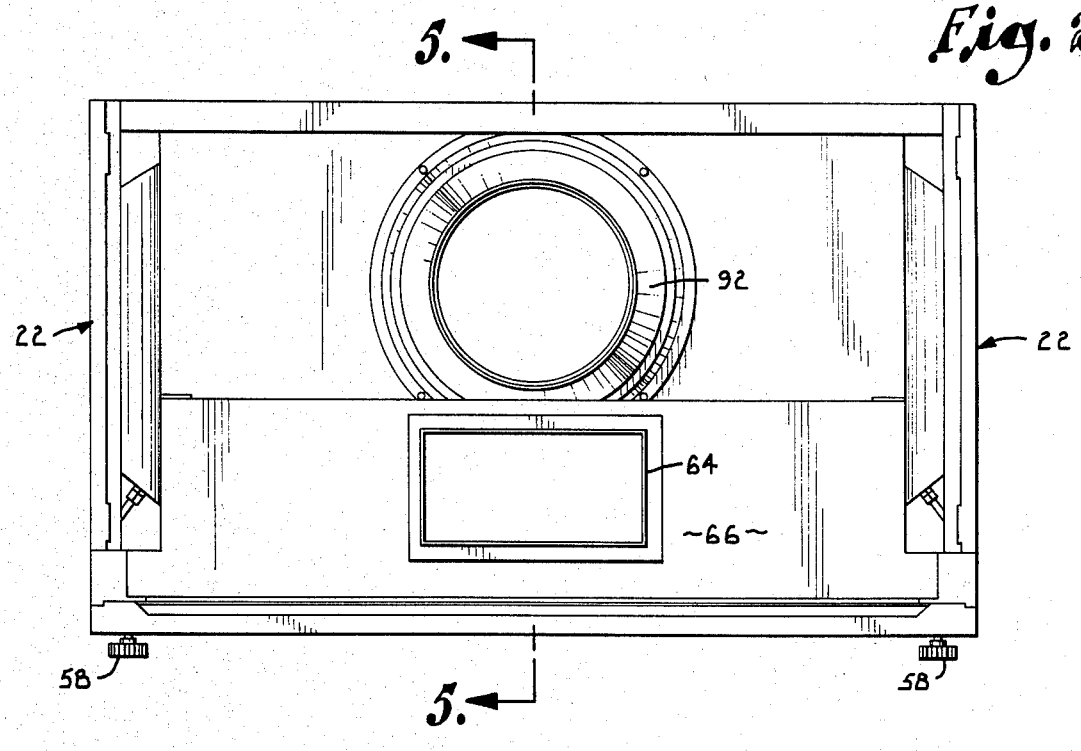
FIG. 2 is a top plan view of the fume hood shown in FIG. 1.

Referring initially to FIG. 1 the laboratory fume hood of the invention is designated generally by the numeral 10 and includes a cabinet structure 12, an auxiliary air system 14 and an exhaust system 16. It is to be understood that the exhaust system 16 includes an exhaust fan 20 of the type illustrated in FIGS. 8 and 9 although the fan is not shown in FIG. 1 and would be positioned spaced upwardly from the top of cabinet structure 12.

Referring to FIGS. 1 and 5, the cabinet structure 12 comprises sidewalls 22 and a back wall 24. A bottom panel 25 is rigid with the aforementioned walls. The two sidewalls 22 are identical except that one is inwardly facing on the left and the other is inwardly facing on the right. Referring to FIG. 6 each sidewall 22 comprises an inner panel 26 and an outer panel 28. Inner panel 26 comprises first and second spaced apart parallel planar surfaces 30 and 32 interconnected by a third surface 34 that is disposed at an acute angle relative to the plane of surface 32.

Figure 4:
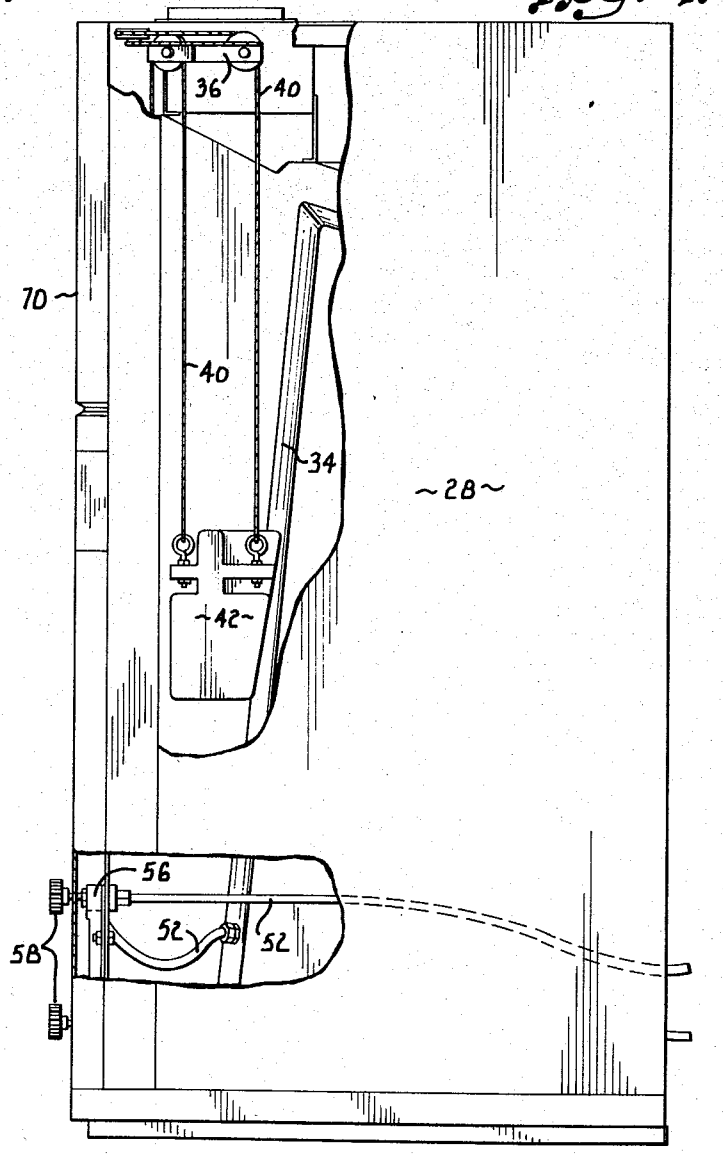
FIG. 4 is a side elevational view, with portions broken away, of the fume hood of FIG. 3.
Figure 3:
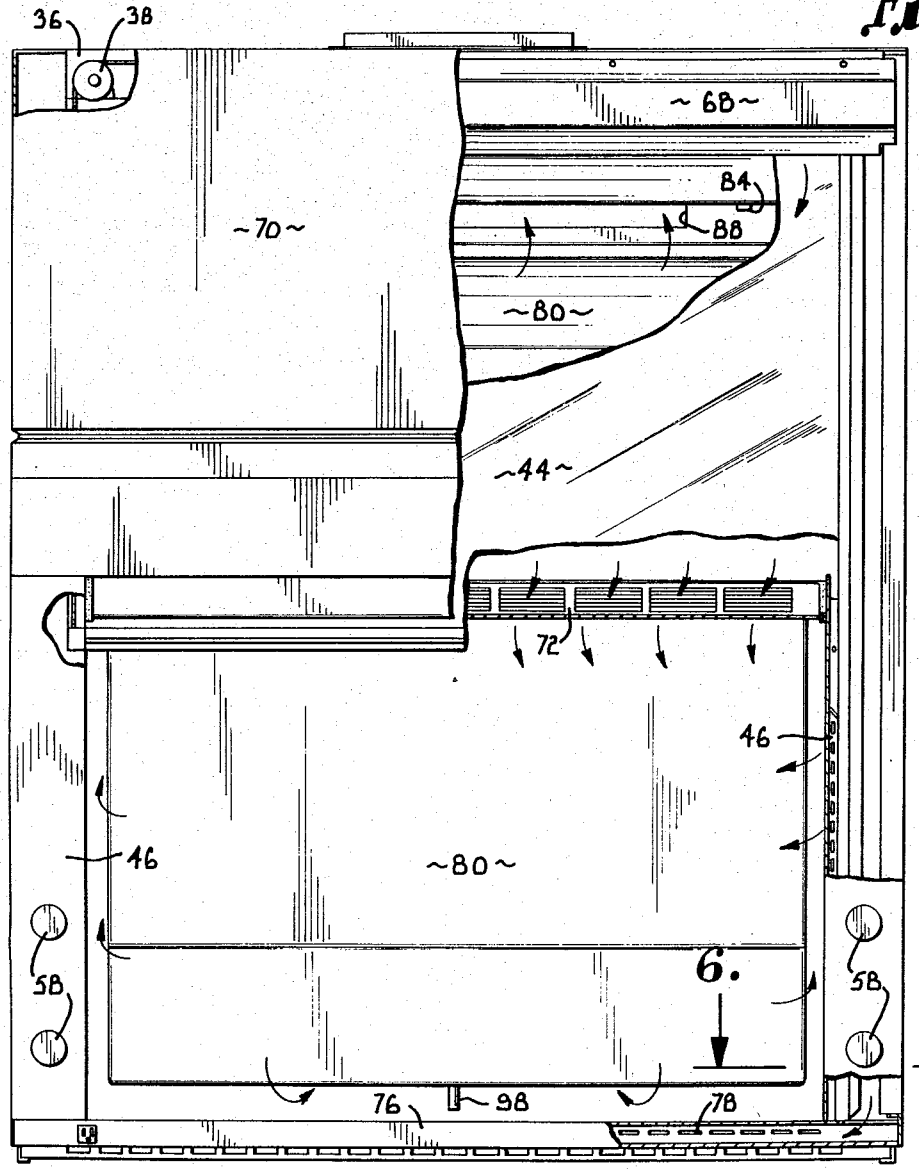
FIG. 3 is an enlarged front elevational view, with portions broken away, of the fume hood shown in FIG. 1.

Referring now to FIGS. 3, 4 and 5, a plurality of brackets 36 rigid with structure 12 mount a series of pulleys 38. Cables 40 are trained over pulleys 38 and the cables are fastened to a counterbalance weight 42. The other ends of the cables are secured to a vertically mounted movable sash 44. Sash 44 is preferably transparent and when in the raised position shown in FIG. 5 presents an access opening to the work area within the cabinet structure.

Again referring to FIG. 6, cabinet structure 12 includes, forwardly of each sidewall 22 a box like housing 46 that extends vertically along the front of the two sidewalls. Housing 46 presents a sash channel 48 along one side in which a channel member 50 rigid with sash 44 is received. Housing 46 is constructed in two pieces comprising a rigid half 46*a* and a second half 46*b* that presents a removable cover.

Extending between the inner and outer panels 26 and 28 of sidewall 22 is a supply line 52 for bringing a liquid or gas to the work area of the fume hood. To this end, a fixture bracket 54 mounts a valve 56 that is operated by a control knob 58 positioned outside of housing 46. Supply line 52 connects valve 56 with a hose connector 60 that extends into the work area in a plane perpendicular to the plane of surface 34. Thus connector 60 is disposed at an acute angle relative to the plane of surface 32 and its leading edge is behind the plane of surface 30. Again it is to be emphasized that a housing 46 identical to the one described except for being left sided would be rigid with the other sidewall 22. Also, as illustrated in FIGS. 1 and 5, in most instances a plurality of hose connectors 60 and associated supply lines, valves and control knobs will be positioned on each of the two sidewalls. Normally, the supply lines will provide such necessities as water, air, nitrogen and natural gas to the work area. It will also be appreciated that the alcove presented by sidewalls 22 provide an efficient and convenient location for installing goose neck connections (deck or wall mounted), cup sinks, and other accessories.

Referring again to FIGS. 1 and 5, a blower 62 is positioned atop cabinet structure 12 and directs air through an inlet duct 64 into an add air plenum 66. A deflector 68 directs air emanating from plenum 66 in a downwardly direction. A removable front cover panel 70 is mounted on the front of cabinet structure 12 in spaced parallel relationship to sash 44. A lower section 70*a* of panel 70 is also removeable and presents a deflector 71 along a lower generally horizontal leg. Deflector 71 has a plurality of holes 71*a* for the passage of air. Thus, when the sash is in its raised open position it cooperates with the front cover panel to present an air duct for channeling the add air into the work area. To this end, another deflector 72 along the bottom of panel 70 is disposed with openings 73 extending at an angle of approximately 45° relative to the plane of the access opening to direct air in the direction of the arrows in FIG. 5. Also, each of the aforedescribed housings 46 is in communication with the air duct presented by sash 44 and cover panel 70 and each housing has a plurality of openings 74 disposed at an angle of approximately 45° relative to the plane of the access opening thereby presenting an air foil for delivery of additional add air into the access opening. Each of the air foils presented by housings 46 are in communication with a bottom sash foil 76 having a plurality of openings 78.

Mounted on the inside of cabinet structure 12 in spaced relationship to back wall 24 is a exhaust air baffle 80. Baffle 80 is mounted to the back wall by a lower bracket 82, on which the foot of baffle 80 rests, and a nut and bolt assembly 84 at the top edge of the baffle. Baffle 80 presents a continuous air directional surface with inlet openings 86 along the bottom half of the baffle and another inlet opening 88 near the top of the baffle. A liner 90 extends from the top end of the exhaust baffle to the top of sash 44 to complete the interior of the cabinet structure.

Disposed at the top of structure 12 beside plenum 66 is a rounded skirt 92 which provides means for connecting the work area with exhaust fan 20. Skirt 92 includes sloping sidewalls 92*a* which terminate in a trough 94 at the bottom of the sidewalls. Trough 94 is slanted toward an integral drain 96. Drain 96 is coupled with a conduit 98 which in turn will normally be coupled with an appropriate receptacle or building drain outlet. An exhaust air duct 100 completes the connection between skirt 92 and exhaust fan 20.

Mounted in parallel relationship to sash 44 on the side of the latter that is opposite the work area is a lighting fixture 102. Fixture 102 includes a reflector 104, fluorescent tubes 106 and a translucent pane 108.

Figure 8:
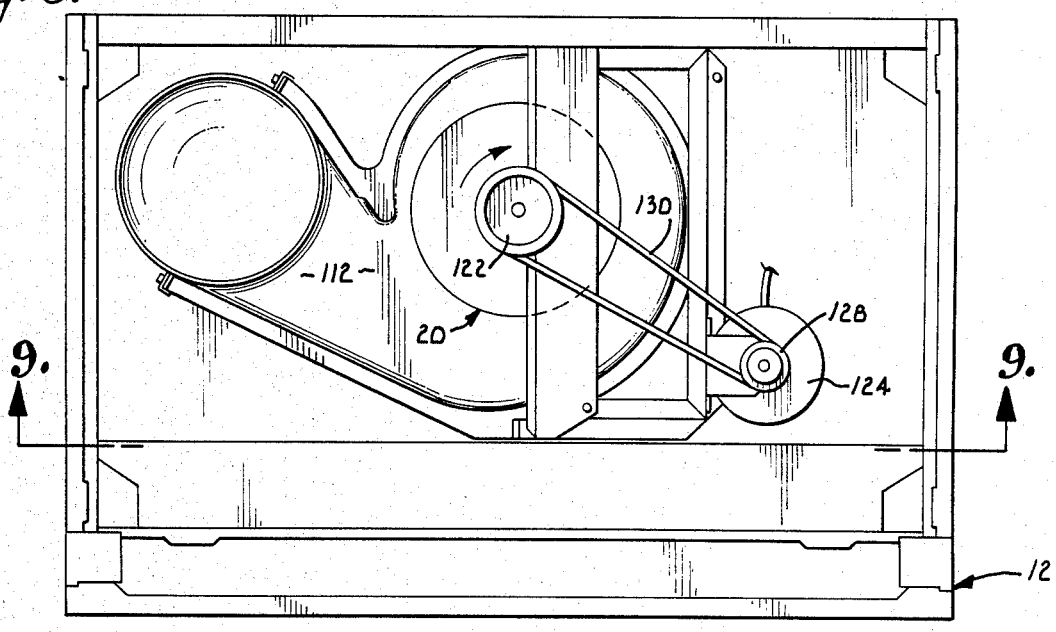
FIG. 8 is a top plan view of an exhaust system according to the present invention.
Figure 9:
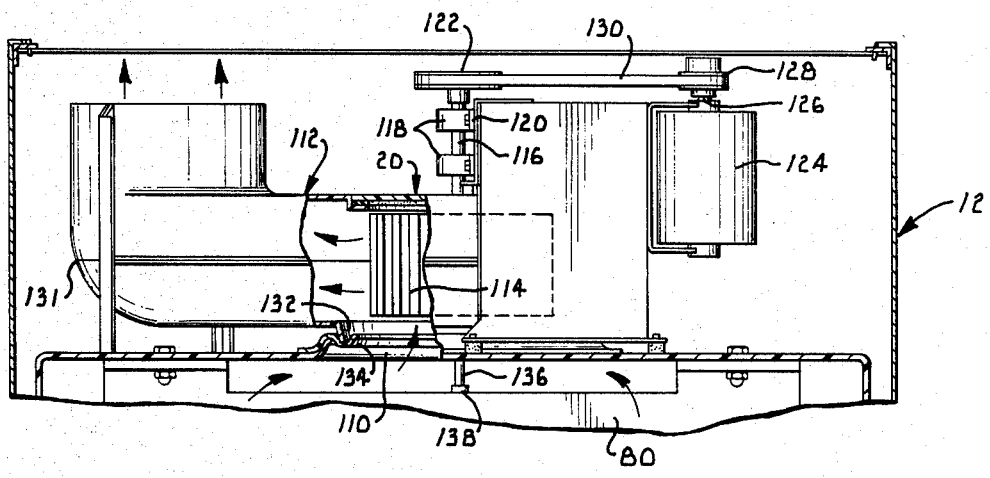
FIG. 9 is a vertical cross-sectional view taken along line 9—9 of FIG. 8.

Referring now to FIGS. 8 and 9, further details of exhaust system 16 will be described. It is to be understood that while exhaust fan 20 may be utilized to remove air from cabinet 22, other types of exhaust air blowers may also be employed. Also, exhaust fan 20 is so designed that in hood installations which are not provided with auxiliary air the fan may be positioned on top of the hood in the manner illustrated in FIGS. 8 and 9. It is to be understood, however, that when the add air feature is present, it will normally be necessary to position fan 20 or some other exhaust blower at a remote location. For purposes of illustrating the present invention, exhaust fan 20 is shown positioned atop the cabinet 12. In this instance, an exhaust air outlet 110 is provided in the top of the hood. A housing 112 encloses a blower wheel assembly 114 mounted on a drive shaft 116. Drive shaft 116 in turn is supported by pillow block bearings 118 mounted on a supporting framework 120. A first sheave 122 is keyed to the end of shaft 116. A prime mover such as an electric motor 124 has an output shaft 126 provided with a variable speed sheave 128. A belt 130 is trained around sheaves 122 and 128 to drive the blower wheel. Housing 112 includes an elbow section 131 which directs air from the blower wheel 114 at an angle of approximately 90° relative to the direction of output of the blower wheel and parallel to the direction of air flowing into the blower wheel. Housing 112 also includes depending sidewalls 132 surrounding outlet opening 110 which sidewalls terminate in a trough 134. An integral drain 136 from the trough is coupled with a conduit 138.

In operation, fume hood 10 is utilized in a laboratory environment where control of fumes is essential. The work area inside of the cabinet is reached through the access opening defined by housings 46, sash foil 76, and sash 44 when the latter is in its opened raised position.

As best illustrated in FIGS. 1, 5 and 6, the placement of hose connectors 60 at an acute angle relative to the plane of surface 32 of inner panel 26 results in a significant increase in the work area inside of the cabinet relative to what it would be if the hose connectors projected at a 90° angle relative to this same surface as is the case with conventional hoods. Also, the disposition of the hose connectors behind the plane of surface 30 of inner panel 26 substantially precludes a worker from catching any clothing on this connector as the worker reaches in and out of the work area. The placement of the hose connectors according to the invention also reduces glassware spillage and breakage caused by accidental contact with the connectors.

By simply taking off control knobs 58 housing section **46*b* can be quickly and easily removed to provide access to control valve 56. This is a significant advantage whenever servicing of the valve is required. It eliminates the need to have an access panel on the side of cabinet structure 12** (either inside or outside) and also eliminates the need to move the cabinet to service the valve when the cabinet is inaccessible from the sides.

Baffle 80 directs air being exhausted by fan 20 along a path at the rear of cabinet structure 12. Again, it is to be emphasized that with the embodiment of the invention shown in FIGS. 1–7 exhaust fan 20 would be positioned at a remote location spaced from the top of the cabinet. Also, exhaust fans other than the specific type of construction shown in FIGS. 8 and 9 could be utilized. With the embodiment shown in FIGS. 8 and 9 the exhaust fan is positioned immediately on top of the cabinet structure. Baffle 80 is held in place solely by the nut and bolt 84 at the top of the baffle. Thus the baffle can be quickly and easily removed for cleaning by simply loosening two nuts. It has been found that the placement of exhaust inlet 86 extending along the sides and bottom of baffle 80, in the lower half of the latter, as well as an additional exhaust inlet opening 88 at the top of the baffle, provides for an even flow of air into the exhaust system. As vapors entrained in the exhausted air pass through skirt 92 they will tend to collect and condense on sidewalls **92*a*. The condensed vapors will run into trough 94 and then be directed by a drain 96 through conduit 98**.

An important feature of the present invention is the add air system. Auxiliary air is provided for the interior of the cabinet by blower 62. Air enters plenum 66 from the blower where it is distributed along the entire front of the cabinet structure. Deflector 68 directs the air downwardly and when sash 44 is in its open raised position the air will travel along the duct presented by the sash and the front panel 70. A portion of the air passes through deflector panel 72 where it enters the access opening to the work area at an angle of approximately 45° relative to the plane of the opening. The remaining air passes through the air foils presented by housings 46 and on into sash foil 76. The openings in housings 46 and sash foil 76 direct air into the access opening and then to the work area. As sash 44 is lowered, a bypass opening is presented at the top of the sash as illustrated in FIG. 7. In this Fig., the sash is shown in an intermediate position where some air enters the bypass opening at the top of the sash while air is still pulled from beneath the sash by the exhaust system. Even with the partial opening illustrated in FIG. 7, however, deflector 68 serves to direct air from the add air plenum into the bypass opening. The auxiliary air continues to be supplied when the sash is in a partially or fully closed, lowered, position. Also, when the sash is in a partially or fully lowered position, exhaust system 16 will draw air from outside of the cabinet through openings 73 and 74 and up through the air duct presented by panel 70 and sash 44. This flow of air will be directed into the work area by fan 20. This is illustrated by the arrows in FIG. 7. This reverse flow of air (relative to the normal direction of flow of add air) helps to keep the velocity of air passing beneath the sash relatively constant regardless of whether the sash is an open, closed, or in an intermediate position.

By virtue of the fact that lighting fixture 102 is positioned in front of sash 44, lights 106 may be serviced by simply removing front cover panel 70 and lowering sash 40. Pane 108 is easily removed to provide access to the interior of the fixture. This represents a substantial improvement over prior hood constructions where the lighting fixtures were much less accessible. Particularly when the add air is traveling in front of the light and the latter is above the hood liner, accessability is a particular problem that is satisfacorily addressed by the present invention.

Referring now to FIGS. 8 and 9, exhaust fan 20 represents a substantial improvement in the art, especially in installations where the fan is positioned immediately on top of the cabinet structure. By virtue of the integral housing 112 which encloses blower wheel 114 and also presents elbow 131 it is not necessary to fabricate an elbow into the interior of the cabinet structure as is the case with any prior art constructions. Likewise, the present invention offers advantages over those prior art constructions which call for a separate elbow outside the hood to connect the exhaust fan. Air enters the fan housing through outlet 110 and is then passed out of the structure in a direction parallel to the direction of input. The provision of a variable speed sheave 128 provides means for adjusting the output speed of blower wheel 114 to meet different operating parameters.

From the foregoing description it is apparent that the improved fume hood construction according to the invention provides substantial advantages over the art and meets the aims and objectives heretofore set forth.

We claim:

1. A fume hood adapted to be coupled with blower means for supplying air to the interior of said hood, the hood comprising:

cabinet structure presenting an enclosed work area and an access opening to said area;

vertically mounted sash means for closing said access opening and movable between a lowered closed position wherein the opening is closed and a raised open position wherein the opening is fully open to flow;

means for coupling said area with a fan for exhausting air from said work area;

plenum means for distributing air from said blower means along the side of said sash means opposite said work area;

cover means mounted on said cabinet structure in spaced relationship to said sash means on the side of the latter that is opposite said work area and cooperating with the sash means in its open position to present a duct for air emanating from said blower means;

deflector means coupled with said cabinet structure along the bortom of said cover means for directing a portion of the air passing through said duct into said work area above the access opening in the open position of said sash means;

air conduit means coupled with said duct for channeling air around the sides of said access opening and into said work area in the open position of said sash means; and a bypass opening for directing air above said sash means from said duct into said work area when said sash means is in the closed position or between the open and closed positions, said sash means closing said bypass opening in the open position and said access opening and bypass opening cooperating to present a substantially constant area at all positions of said sash means between the open and closed positions thereof to prevent said fan from effecting undue variations in the air velocity through the access opening between the open and closed positions of said sash means.

2. A fume hood as set forth in claim 1, wherein said deflector means comprises a substantially planar deflector member arranged at an acute angle relative to the plane of said access opening and apertured to direct air from said duct downwardly and inwardly into said access opening from above same.

3. A fume hood as set forth in claim 1, wherein said air conduit means extends around the sides and below said access opening to direct air into the latter from the sides and bottom thereof and said exhaust fan draws air through said conduit means when said sash means is moved away from said open position.

4. A fume hood as set forth in claim 1, wherein said cabinet structure comprises sidewalls and a back wall defining said work area, each of said sidewalls presenting first and second planar surfaces disposed in spaced parallel planes and interconnected by a third surface disposed at an acute angle relative to the plane of said first and second surfaces; and including a hose connector for connecting a supply hose to said structure, said connector being disposed on one of said third surfaces of one of said sidewalls and projecting into said work area at an orientation substantially perpendicular to said one third surface.

5. A fume hood as set forth in claim 4, wherein is included an exhaust air baffle coupled with said back wall in spaced relationship to the latter for directing air from said work area to said exhaust fan, said baffle being characterized by an intake opening therein extending along substantially the entire lower vertical half of said work area.

6. A fume hood as set forth in claim 1, wherein said structure comprises sidewalls and a back wall, each of said sidewalls comprising inner and outer spaced apart panels; hose connector means coupled with at least one of said sidewalls and extending into said work area; means presenting a housing coupled with said structure and disposed forwardly of each of said sidewalls on opposite sides of said access opening; valve means disposed in said housing; control means disposed outside of said housing and coupled with said valve means; a supply line extending between said inner and outer panels and coupled with said valve means and said connector means; and removable cover means on said housing means for providing access to said valve means from the front of the cabinet structure on one side of the access opening.

7. A fume hood as set forth in claim 1, wherein said sash means is substantially transparent to permit the passage of light; and including a hood liner forming the top of said working area and fixture means for mounting a light source, said fixture means being mounted on said cabinet structure at a location spaced below said hood liner on the side of said sash means that is opposite said work area and behind said cover means, said cover means being removable to provide access to said fixture means from the inside thereof when said sash means is in the closed position.

8. A fume hood adapted to be coupled with an exhaust fan comprising:

cabinet structure presenting an enclosed work area defined by sidewalls, a back wall and an access opening formed between front ends of the sidewalls, each of said sidewalls presenting at said front end thereof first and second planar surfaces disposed in space parallel planes and interconnected by a third surface disposed at an acute angle relative to the plane of one of said first and second surfaces;

means for connecting a supply hose to said structure, said connecting means including a hose connector disposed on one of said third surfaces of one of said sidewalls and projecting into said work area at an orientation substantially perpendicular to said one third surface;

vertically mounted sash means for closing said access opening and movable between a lowered position wherein the opening is closed and a raised open position, said sash means being substantially transparent to permit the passage of light;

means for coupling said structure to said exhaust fan;

a hood liner forming the top of said work area;

fixture means for mounting a light source, said fixture means being mounted on said cabinet structure at a location spaced below said hood liner on the side of said sash means that is opposite said area; and cover means mounted on said structure in spaced relationship to said sash means, said cover means being removable to provide access to said fixture means from the inside thereof when said sash means is in the lowered position.

9. A fume hood as set forth in claim 8, wherein is included a plurality of said hose connectors disposed on said third surfaces of said sidewalls and each oriented substantially perpendicular to the corresponding third surface.

10. A fume hood as set forth in claim 9, wherein is included an exhaust air baffle coupled with said back wall in spaced relationship to the latter for directing air from said work area to said exhaust fan, said baffle being characterized by an air intake opening extending along substantially the entire lower vertical half of said work area.

11. A fume hood comprising:

cabinet structure presenting an enclosed work area and an access opening to said area, said structure presenting first and second sidewalls and a back wall, each of said sidewalls comprising inner and outer spaced apart panels;

hose connector means coupled with at least one of said sidewalls and extending into said work area;

means presenting a housing coupled with said structure and disposed forwardly of each of said sidewalls on opposite sides of said access opening;

valve means disposed in said housing;

control means disposed outside of said housing and coupled with said valve means for operating same;

a supply line extending between said inner and outer panels and coupled with said valve means and said connector means;

removable cover means on a front surface of said housing means for providing access to said valve means from the front of the cabinet structure;

vertically mounted transparent sash means for closing said access opening and movable between a lowered position wherein the opening is closed and a raised open position;

a hood liner at the top of said work area;

fixture means for mounting a light source, said fixture means being disposed on said structure at a location spaced below said hood liner on the side of said transparent sash means that is opposite said area; and cover means mounted on said structure in spaced relationship to said transparent sash means, said cover means being removable to provide access to said fixture means when said sash means is in the lowered position.

12. A fume hood as set forth in claim 11, wherein each of said housing means abuts said sidewalls and presents an extension of said inner and outer panels.

13. A fume hood as set forth in claim 11, wherein each of said inner panels comprises first and second planar surfaces disposed in spaced parallel planes and interconnected by a third surface disposed at an acute angle relative to the plane of one of said first and second surfaces; and including means for connecting a supply hose to said structure, said connecting means including a hose connector disposed on one of said third surfaces of said inner panels and projecting into said work area at an orientation substantially perpendicular to said one third surface.

14. A fume hood comprising:

cabinet structure presenting an enclosed work area and an access opening to said area, said cabinet structure having a hood liner at the top of the work area;

vertical sash means for closing said access opening and movable between a lowered position wherein the opening is closed and a raised open position, said sash means being substantially transparent to permit the passage of light;

fixture means for mounting a light source, said fixture means being mounted on said cabinet structure at a location spaced below the hood liner on the side of said sash means that is opposite said area;

cover means mounted on said structure in spaced relationship to said sash means and said fixture means, said cover means being removable to provide access to said fixture means from the inside thereof when said sash means is in the lowered position.

15. A fume hood as set forth in claim 14, wherein said fixture means includes reflector means extending transversely across said work area.

16. A fume hood adapted to be coupled with a blower means for supplying air to the interior of the hood, said hood comprising:

cabinet structure presenting an enclosed work area defined by sidewalls, a back wall and an access opening;

each of said sidewalls comprising inner and outer spaced panels, each of said inner panels presenting first and second planar surfaces disposed in spaced parallel planes and interconnected by a third surface disposed at an acute angle relative to the plane of one of said first and second surfaces;

means for connecting a supply hose to said structure, said connecting means being disposed on one of said third surfaces and projecting into said work area;

means presenting a housing coupled with said structure and disposed forwardly of each of said sidewalls on opposite sides of said access opening;

valve means disposed in said housing;

control means disposed outside of said housing and coupled with said valve means;

a supply line extending between said inner and outer panels and coupled with said valve means on said connector means;

first removable cover means on said housing means for providing access to said valve means;

vertically mounted transparent sash means for closing said access opening and movable between a lowered position wherein the opening is closed and a raised open position;

fixture means for mounting a light source, said fixture means being mounted on said cabinet structure on the side of said transparent sash means that is opposite said area;

second removable cover means mounted on said cabinet structure in spaced relationship to said transparent sash means on the side of the latter that is opposite said work area and cooperating with said transparent sash means in its open position to present an air duct, said second cover means being removable to provide access to said fixture means;

plenum means for distributing air from said blower means through said duct presented by said second cover means and said transparent sash means;

an apertured deflector on said cabinet structure extending along the bottom of said second cover means and occupying a plane oriented at an acute angle relative to the plane of said access opening for directing a portion of the air passing through said duct into said work area in a downwardly and inwardly direction from above the access opening;

air conduit means coupled with said duct for channeling air around the sides of said access opening;

a plurality of outlet openings from said air conduit means located on opposite sides of said access opening and angled acutely to the plane of the access opening to direct air into the work area from opposite sides of said access opening;

means for coupling said work area with an exhaust fan, said exhaust fan coupling means including a housing having sidewalls on which vapors collect and condense as gases are exhausted by said fan;

trough means coupled with said housing along the bottom edge of said sidewalls whereby condensed liquid from said sidewalls will collect in said trough means; and conduit means coupled with said trough means for directing liquid from said trough means to a remote location.

* * * * *